United States Patent [19]

Cook

[11] Patent Number: 4,886,026

[45] Date of Patent: Dec. 12, 1989

[54] FUEL INJECTION CONTROL SYSTEM

[75] Inventor: Jeffrey A. Cook, Dearborn, Mich.

[73] Assignee: Ford Motor Company, Dearborn, Mich.

[21] Appl. No.: 239,378

[22] Filed: Sep. 1, 1988

[51] Int. Cl.[4] ..... F02D 41/34

[52] U.S. Cl. ..... 123/478; 123/520

[58] Field of Search ..... 123/179 L, 478, 491, 123/492, 445, 520

[56] References Cited

U.S. PATENT DOCUMENTS

| | | | |
|---|---|---|---|
| 3,868,936 | 3/1975 | Rivere | 123/445 |
| 3,963,009 | 6/1976 | Mennesson . | |
| 4,013,054 | 3/1977 | Balsley et al. . | |
| 4,242,992 | 1/1981 | Kawamura et al. | 123/491 |
| 4,481,672 | 12/1983 | Muller et al. . | |
| 4,610,236 | 9/1986 | Okino . | |
| 4,612,889 | 9/1986 | Sugiura et al. . | |
| 4,612,904 | 9/1986 | Tadokoro et al. | 123/492 |
| 4,646,702 | 3/1987 | Matsubara et al. | 123/520 |
| 4,677,956 | 7/1987 | Hamburg . | |
| 4,741,318 | 5/1988 | Kortge et al. . | |
| 4,829,966 | 5/1989 | D'Angelo et al. | 123/478 |

FOREIGN PATENT DOCUMENTS

| | | | |
|---|---|---|---|
| 52378 | 11/1982 | Japan | 123/492 |
| 229024 | 12/1984 | Japan | 123/492 |

*Primary Examiner*—Tony M. Argenbright

*Attorney, Agent, or Firm*—Allan J. Lippa; Peter Abolins

[57] ABSTRACT

A fuel delivery control system for a multiport fuel injected internal combustion engine. A fuel vapor recovery system periodically purges fuel vapors from the fuel system into the intake manifold under control of a purge controller. The intake manifold has a separate runner coupled to each combustion chamber with a separate primary fuel injector coupled thereto. A secondary fuel injector of smaller size is coupled to the intake manifold upstream of the primary fuel injectors. Primary and secondary fuel injectors are controlled, respectively, by a primary fuel injection controller and a secondary fuel injection controller. Both primary and secondary fuel injection controllers are responsive to a desired fuel charge related to a desired air/fuel ratio of a mixture of air, injected fuel, and fuel vapors injected into the engine. The desired fuel charge is generated in response to a measurement of inducted airflow and a feedback indication of actual air/fuel ratio from an exhaust gas oxygen sensor. When the desired fuel charge is below the linear range of the primary fuel injectors, the primary fuel injector controller is disabled and the second fuel injector controller enabled. Conversely, when the desired fuel charge is within the linear range of the primary fuel injectors, the primary fuel injector controller is enabled and the second fuel injection controller is disabled.

5 Claims, 4 Drawing Sheets

FUEL INJECTION CONTROL SYSTEM

BACKGROUND OF THE INVENTION

The field of the invention relates to fuel control systems for fuel injected engines which include fuel vapor recovery systems. In particular, the invention is applicable to fuel injected engines wherein the intake air/fuel ratio is regulated via a feedback loop from an exhaust gas oxygen sensor (EGO).

Feedback control of fuel injected engines is known. Typically, mass airflow inducted through the engine is measured and a corresponding desired fuel charge calculated which corresponds to a desired air/fuel ratio. In response, the pulse width of an electronic signal applied to the fuel injectors is varied in an effort to achieve the desired fuel charge. A feedback loop responsive to an exhaust gas oxygen sensor (EGO) further trims the pulse width such that the actual air/fuel ratio approaches the desired air/fuel ratio. The injectors are manufactured to close tolerances such that the relationship of fuel delivered to pulse width is reasonably linear over the operating range of the engine (idle to full load), otherwise, accurate air/fuel ratio control is not achievable.

Fuel vapor recovery systems are also known wherein a portion of evaporative fuel vapors from the fuel system are absorbed in a vapor recovery canister, typically containing activated charcoal, to prevent discharge of fuel vapors into the atmosphere. Under certain engine operating conditions, usually when inducted mass airflow is above a threshold value, ambient air is inducted through the canister into the engine intake, a condition referred to as purging. During a purge cycle, evaporative fuel vapors may also be inducted directly into the engine from the fuel system.

It is also known to combine feedback control systems with fuel vapor recovery systems. For example, U.S. Pat. No. 4,013,054 issued to Balsley et al and U.S. Pat. No. 3,963,009 issued to Mennesson disclose a fuel vapor recovery system coupled to the engine intake via an electronically controllable valve. A carburetor coupled to the engine air intake is set for an air/fuel ratio leaner than desired. The purge rate is regulated by electronically adjusting the valve in response to an EGO sensor. By regulating the purge flow rate, allegedly, the desired air/fuel ratio is achieved.

U.S. Pat. No. 4,677,956 issued to Hamburg discloses a fuel injected engine coupled to a fuel vapor recovery system. The fuel injector is regulated in response to an EGO sensor to achieve the desired air/fuel ratio.

The inventor herein has recognized a problem with fuel injected engines coupled to fuel vapor recovery systems wherein the air/fuel ratio is regulated in response to an EGO sensor. The problem is that when inducting evaporative fuel vapors at low engine loads, the fuel charge desired from the fuel injectors to achieve a desired air/fuel ratio may be below the linear range of the fuel injectors. That is, the amount of fuel required from the fuel injectors while purging fuel vapors at low engine loads may be so small that it is below the linear range of conventional fuel injectors. This situation is more likely to occur in multiport fuel injected engines (one fuel injector coupled to each combustion chamber rather than a single fuel injector coupled to the engine intake) wherein the pulse width of each multiport injector is considerably less than that required by a single main injector. Since, under the operating conditions described above, the relationship between fuel delivered and pulse width is nonlinear, accurate fuel control and accordingly accurate air/fuel ratio control is not obtainable.

The approaches described above, apparently, did not have to consider this problem since those approaches generally do not purge fuel vapors when the inducted airflow is below a threshold. Stated another way, prior approaches have only purged fuel vapors when the mass airflow was above a threshold to minimize the effect of purged fuel vapors upon the air/fuel ratio. The inventors herein have recognized that it is desirable to purge fuel vapors as frequently as possible including the purge of vapors during idle. Further, future government regulations may further limit the atmospheric discharge of fuel vapors thereby requiring the purge of vapors during idle and low engine loads. The prior approaches, however, will not achieve a desired air/fuel ratio when purging at idle or low engine loads.

SUMMARY OF THE INVENTION

An object of the invention herein is to provide a fuel control system for achieving accurate air/fuel ratio control in fuel injected engines coupled to fuel vapor recovery systems.

The above problems and disadvantages are overcome and object achieved by providing a fuel control system for an internal combustion engine having an intake manifold for inducting air and fuel into the combustion chambers and an exhaust manifold coupled to the exhaust chambers. In one particular aspect of the invention, the fuel control system comprises: at least one primary fuel injector coupled to the intake manifold for delivering fuel in proportion to the pulse width of a primary electronic signal; a secondary fuel injector coupled to the intake manifold for delivering fuel in proportion to the pulse width of a secondary electronic signal; an airflow sensor coupled to the intake manifold for measuring airflow inducted into the engine; an exhaust gas sensor coupled to the exhaust manifold for providing an indication of air/fuel ratio inducted into the engine; fuel calculation means responsive to both the airflow sensor and the exhaust gas sensor for calculating a desired fuel charge to be inducted into the engine to maintain a predetermined air/fuel ratio; first means responsive to the desired fuel charge for generating the primary electronic signal having a pulse width related to the desired fuel charge; second means responsive to the desired fuel charge for generating the secondary electronic signal having a pulse width related to the desired fuel charge; and control means responsive to the desired fuel charge for enabling the primary signal and disabling the secondary signal when the desired fuel charge is above a preselected value and for disabling the primary signal and enabling the secondary signal when the desired fuel charge is below the preselected value. Preferably, the secondary fuel injector requires a wider pulse width than the primary fuel injector to deliver substantially the same fuel as the primary fuel injector.

In accordance with the above aspects of the invention, the control system is always selecting a fuel injector, either primary fuel injector or secondary fuel injector, which has a linear relationship between delivered fuel charge and pulse width. An advantage is thereby obtained of accurate fuel delivery and, accordingly, air/fuel ratio control, regardless of the desired fuel charge which is calculated. This aspect of the invention is particularly advantageous when the engine intake is also coupled to a fuel vapor recovery system. Thus, during fuel vapor purging at low engine loads, accurate air/fuel ratio control is obtainable which heretofore was not possible with prior approaches. An additional advantage is thereby obtained of enabling fuel vapor purging at low engine loads while maintaining accurate air/fuel ratio control.

DESCRIPTION OF THE DRAWINGS

The object and advantages may be better understood by reading the following example of an embodiment wherein the invention is used to advantage with particular reference to the drawings, wherein.

DESCRIPTION OF THE PREFERRED EMBODIMENT

Figure 1:
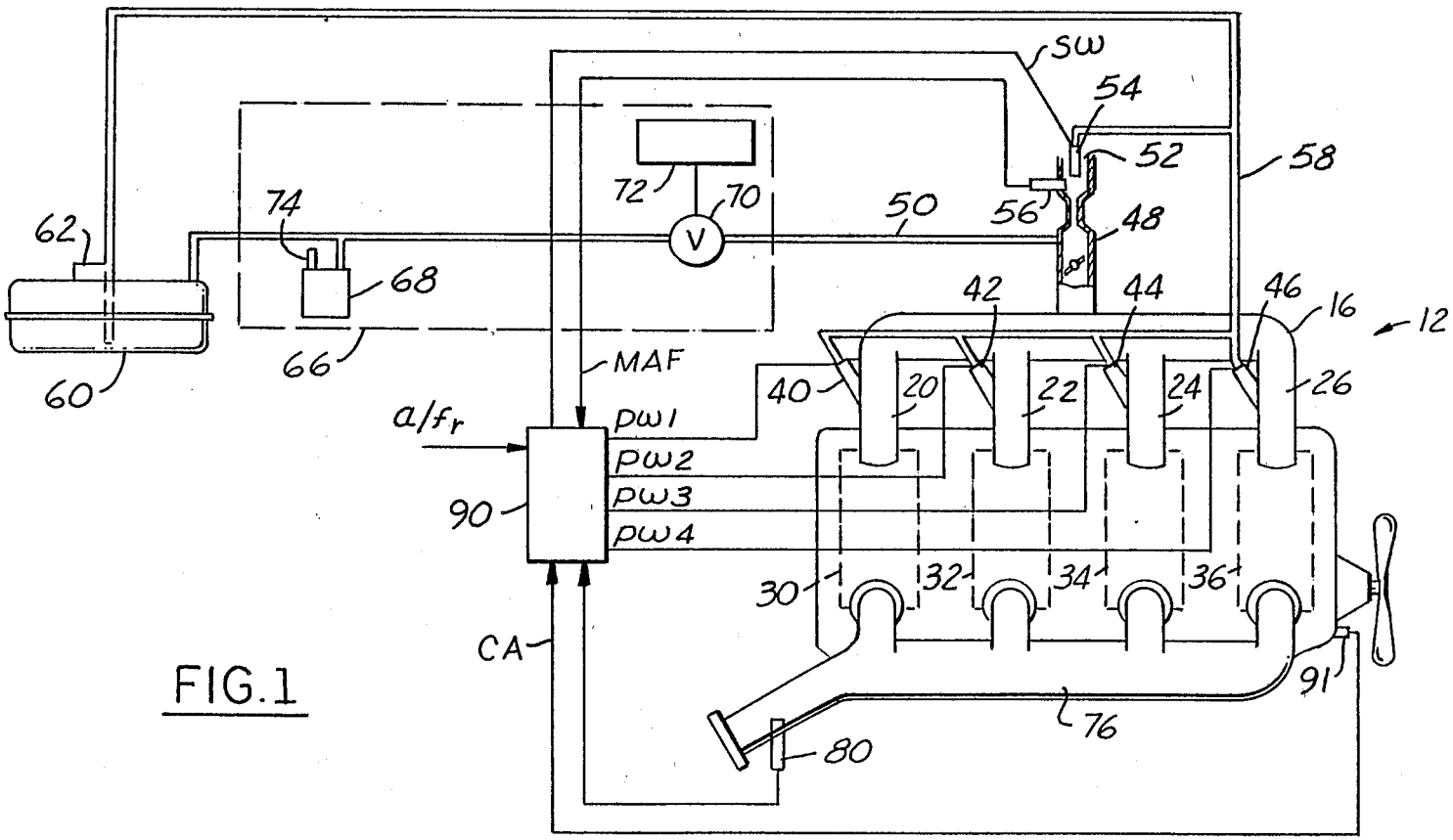
FIG. 1 is a block diagram of a fuel control system coupled to a multiport fuel injected engine having a fuel vapor recovery system also coupled thereto.

Referring first to FIG. 1, internal combustion engine 12 is shown in this example as a four cylinder, four stroke engine having sequentially operated, multiport fuel injection. Engine 12 is shown including intake manifold 16 having individual ports or runners 20, 22, 24, and 26 respectively coupled to combustion chambers 30, 32, 34, and 36. Primary fuel injectors 40, 42, 44 and 46 are shown respectively coupled to runners 20, 22, 24, and 26 near the respective intake valves (not shown) of respective combustion chambers 30, 32, 34, and 36. Intake manifold 16 is also shown connected to throttle controlled induction passage 48. Fuel vapor recovery purge line 50, inducted air inlet 52, secondary fuel injector 54, and mass airflow sensor 56 are shown coupled to induction passage 48. Mass airflow sensor 56 generates signal MAF related to the mass of airflow inducted into engine 12.

Fuel rail 58 is shown coupled to primary fuel injectors 40, 42, 44, and 46, and also to secondary fuel injector 54 for providing pressurized fuel from fuel tank 60 via conventional pump assembly 62. A pressure regulator valve (not shown) coupled to fuel rail 58 and a return fuel line (not shown) maintains fuel pressure at a predetermined pressure, typically 40 psi, for proper operation of the fuel injectors.

Fuel vapor recovery system 66 is shown coupled between fuel tank 60 and induction passage 48. Fuel vapor recovery system 66 is here shown including vapor storage canister 68, a conventional vapor recovery canister containing activated charcoal for storing hydrocarbons, and solenoid actuated valve 70 controlled by purge controller/driver 72 for controlling the purge flow rate through fuel vapor purge line 50. When valve 70 is actuated, manifold vacuum from engine 12 draws ambient air through canister 68 via ambient air inlet 74 purging stored fuel vapors into induction passage 48. In addition, fuel vapors from fuel tank 60 are also purged into induction passage 48 for the example illustrated herein.

Continuing with FIG. 1, exhaust manifold 76 is shown coupled to combustion chambers 30, 32, 34, and 36. Exhaust gas oxygen sensor 80 is shown positioned in exhaust manifold 76 for providing an indication of the ratio of inducted air to both inducted purged fuel vapors and inducted fuel. For the example described herein, EGO sensor 80 is a two-state sensor which provides an indication that the air/fuel ratio is either on the rich side or the lean side of a desired air/fuel ratio. Typically, the desired air/fuel ratio is chosen to be within the operating window of a three-way catalytic converter (CO, $NO_X$, and HC), a condition referred to as stoichiometry.

Figure 2:
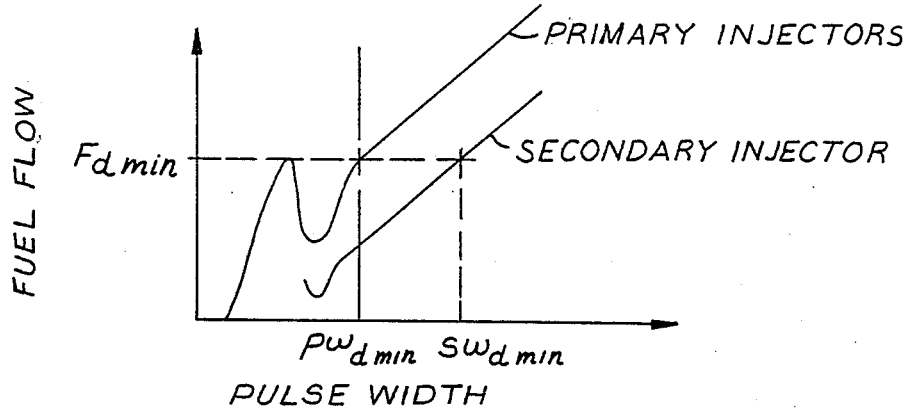
FIG. 2 shows the fuel flow characteristics of both a primary fuel injector and a secondary fuel injector used to advantage in the embodiment shown in FIG. 1.

In general terms, which are described in greater detail hereinafter with particular reference to FIG. 3, fuel controller 90 actuates primary fuel injectors 40, 42, 44, and 46 by respective primary signals $pw_1$, $pw_2$, $pw_3$, and $pw_4$ in time relation to the crank angle (CA) position of respective combustion chambers 30, 32, 34 and 36. Referring to FIG. 2, the fuel flow from each of the primary fuel injectors is proportional to the pulse width of the respective primary signal ($pw_1$–$pw_4$). Each primary fuel injector is manufactured to close tolerance for achieving a substantially linear relationship of fuel flow to pulse width from maximum fuel flow to a minimum fuel flow ($F_{dmin}$) associated with idle. If the fuel flow desired by fuel controller 90 falls below $F_{dmin}$, the primary fuel injectors will operate in a nonlinear region and accurate fuel control would be severely impeded. Without action by the invention described herein, operation in the nonlinear range of the primary fuel injectors may otherwise occur during a fuel vapor purge while operating at low engine loads. For example, as described in greater detail hereinafter, fuel controller 90 alters the pulse width of the primary signals ($pw_1$–$pw_4$) in response to EGO sensor 80. Since the air/fuel ratio is a mixture of inducted air, purged fuel vapors and fuel, fuel controller 90 will decrease the fuel delivered by the primary fuel injectors when fuel vapors from fuel vapor recovery system 66 are inducted into engine 12. Thus, when purging during light engine loads, the fuel flow ($F_d$) required from the primary fuel injectors may be less than $F_{dmin}$. Under these conditions, the primary fuel injectors would operate in the nonlinear range and accurate fuel control would be inhibited. For reasons described in greater detail hereinafter with particular reference to FIG. 3, accurate air/fuel control is maintained during vapor purge at light engine loads through action of fuel controller 90 by deactivating the primary fuel injectors and appropriately activating secondary fuel injector 54 when the desired fuel flow falls below $F_{dmin}$. As shown in FIG. 2, secondary fuel injector 54 is linear over a lower range of fuel flow than the primary fuel injectors. For this example, the primary fuel injectors provide linear fuel flow from about 80% of the maximum pulse width of the injector to about 3 m/sec pulse width, and secondary fuel injector 54 provides linear fuel flow from 3 m/sec and below to about 1.5 m/sec.

Figure 4:
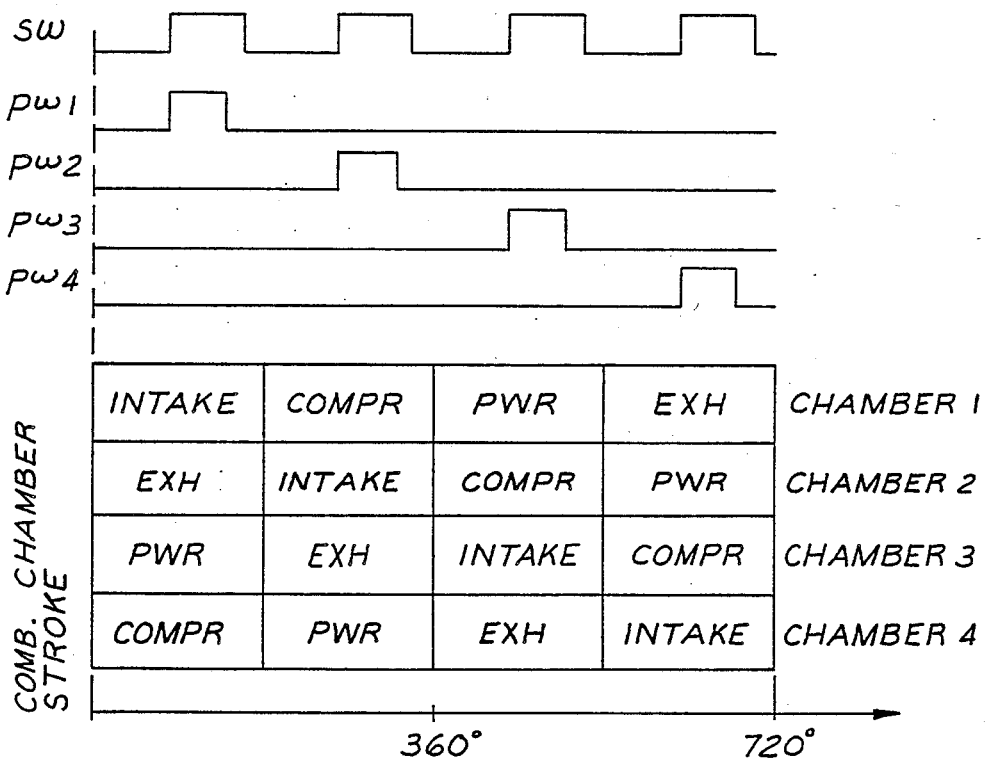
FIG. 4 shows a timing diagram of both the engine and fuel control system shown in FIGS. 1 and 2.
Figure 3:
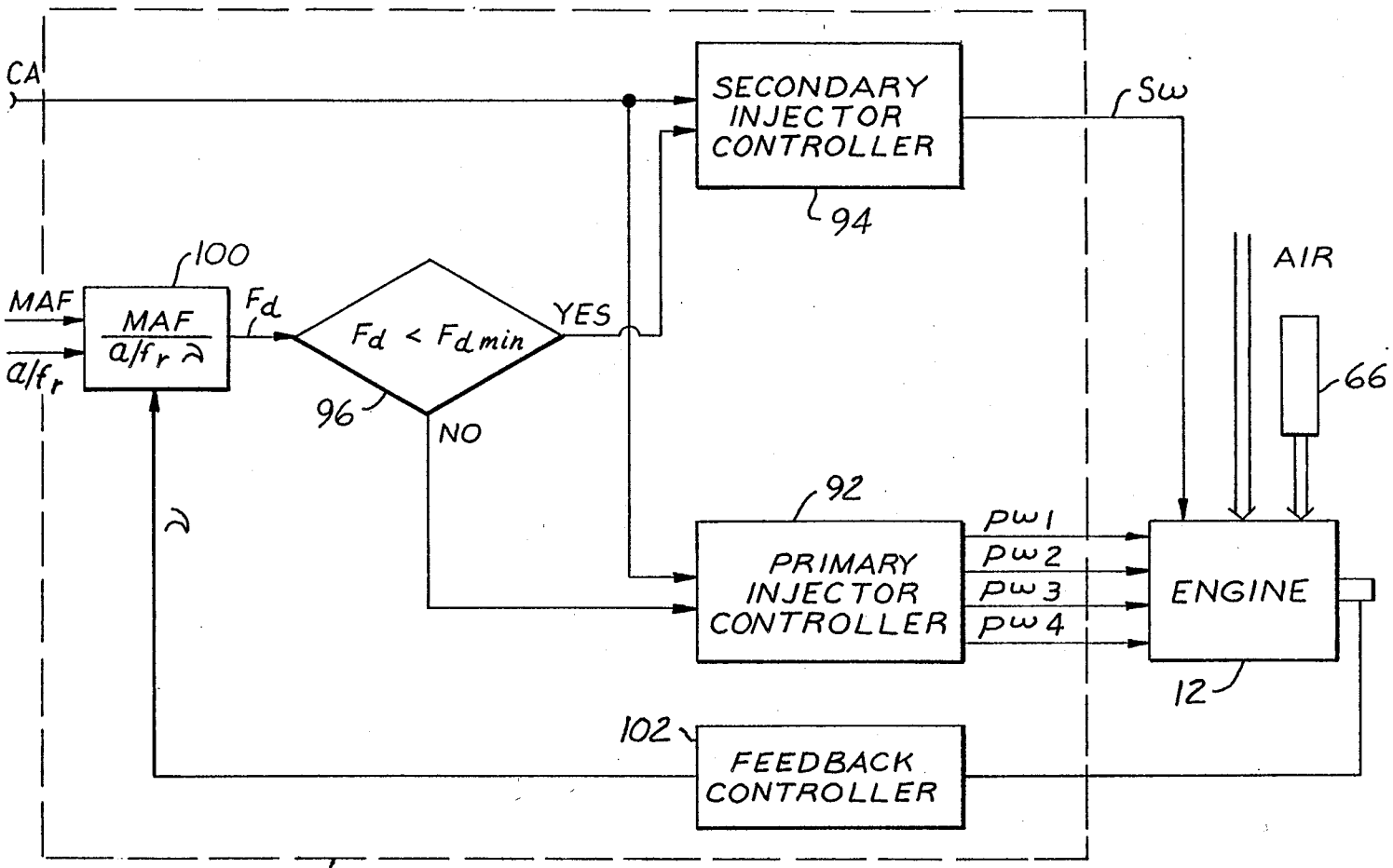
FIG. 3 shows an electrical block diagram of the fuel control system shown in FIG. 1.

Referring now to the electrical block diagram shown in FIG. 3 and associated timing diagram shown in FIG. 4, fuel controller 90 and fuel vapor recovery system 66 are also shown coupled to engine 12. Fuel controller 90 is shown including primary fuel injector controller 92 and secondary fuel injector controller 94. Primary fuel injector controller 92, in this example, contains a map of pulse width versus fuel flow (as shown by the graphical representation in FIG. 2) for the primary fuel injectors (40, 42, 44, and 46). When actuated by desired fuel flow signal ($F_d$) from decision block 96, primary fuel injector controller 92 provides primary signals $pw_1$, $pw_2$, $pw_3$, and $pw_4$, in time relation to CA for driving respective primary fuel injectors 40, 42, 44, and 46. Similarly, secondary fuel injector controller 94 contains a map of pulse width versus fuel flow for secondary fuel injector 54 (as shown by the graphical representation in FIG. 2). In response to desired fuel flow signal ($F_d$) from decision block 96, secondary fuel injector controller 94 provides secondary signal sw for driving secondary fuel injector 54 in time relation to signal CA.

The structure and operation of fuel controller 90, as shown in FIG. 3, is better understood by first discussing open loop operation without feed back correction λ. For open loop operation, calculation block 100 multiplies MAF times the inverse of the desired or reference air/fuel ratio to generate a desired fuel flow signal ($F_d$) related to the desired fuel charge to be delivered to the combustion chambers (30, 32, 34, and 36). That is, $F_d = MAF(a/f_r)^{-1}$. The reference air/fuel ratio ($a/f_r$) in this example is selected at stoichiometry which is typically 14.7 lbs. air/1 lb. fuel.

During closed loop operation, EGO sensor 80 provides an indication of whether the actual air/fuel ratio of the mixture of air, purged fuel vapors, and injected fuel which is inducted into the combustion chambers, is either on the rich side or the lean side of stoichiometry. In response, feedback controller 102, a proportional integral feedback controller in this example, provides correction factor λ to calculation block 100 for correcting desired fuel flow signal $F_d$. Thus, during closed loop operation, $F_d = MAF\ (a/f_r)^{-1}\lambda^{-1}$. Decision block 96 compares desired fuel flow signal $F_d$ to the minimum fuel flow ($F_{dmin}$) of the linear range of the primary fuel injectors (40, 42, 44, and 46) as shown in FIG. 2. If $F_d$ is greater than $F_{dmin}$, then $F_d$ is coupled to primary fuel injector controller 92 and decoupled from secondary fuel injector controller 94. Thus, the primary fuel injectors (40, 42, 44, and 46) are enabled and secondary fuel injector 54 is disabled. Primary fuel injector controller 92 generates primary signals $pw_1$, $pw_2$, $pw_3$, and $pw_4$, each having the pulse width required by the respective primary fuel injectors (40, 42, 44, and 46) for delivering desired fuel flow $F_d$. Primary fuel injector controller 92 also generates each of the primary signals ($pw_1$–$pw_4$) in time relation to CA such that each primary signal ($pw_1$–$pw_4$) is generated on the intake stroke of the respective combustion chamber (30, 32, 34, or 36) as shown in FIG. 4.

In the event that $F_d$ is less than $F_{dmin}$, a condition which may occur while inducting purged fuel vapors at low engine loads, then $F_d$ is coupled to secondary fuel injector controller 94 and decoupled from primary fuel injector controller 92. Thus, secondary fuel injector controller 94 generates secondary signal sw with the pulse width required by secondary fuel injector 54 to deliver desired fuel flow $F_d$. Secondary fuel injector controller 94 also generates sw in time relation to CA such that sw is generated on each intake stroke of each combustion chamber (30, 32, 34, and 36) as shown in the example presented in FIG. 4. It is noted that the pulse width of sw is less than the corresponding pulse width of $pw_1$–$pw_4$since fuel injector 54 is physically scaled down from the primary fuel injectors (40, 42, 44, and 46) to achieve the extended lower linear range desired. For example, referring to FIG. 2, the secondary pulse width ($sw_{dmin}$) associated with $F_{dmin}$ is larger than the primary pulse width ($pw_{dmin}$) associated with $F_{dmin}$. It is also noted that in operation, $sw_{dmin}$ is the maximum pulse width that secondary fuel injector 54 will operate at, and conversely, $pw_{dmin}$ is the minimum pulse width that the primary fuel injectors (40, 42, 44, and 46) will operate at.

Figure 5:
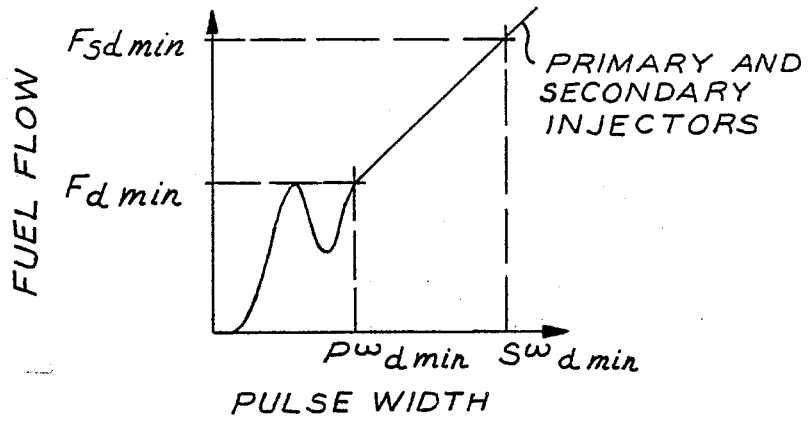
FIG. 5 shows an alternate embodiment in which the invention is used to advantage wherein the primary and secondary fuel injectors have the same fuel flow characteristics.
Figure 6:
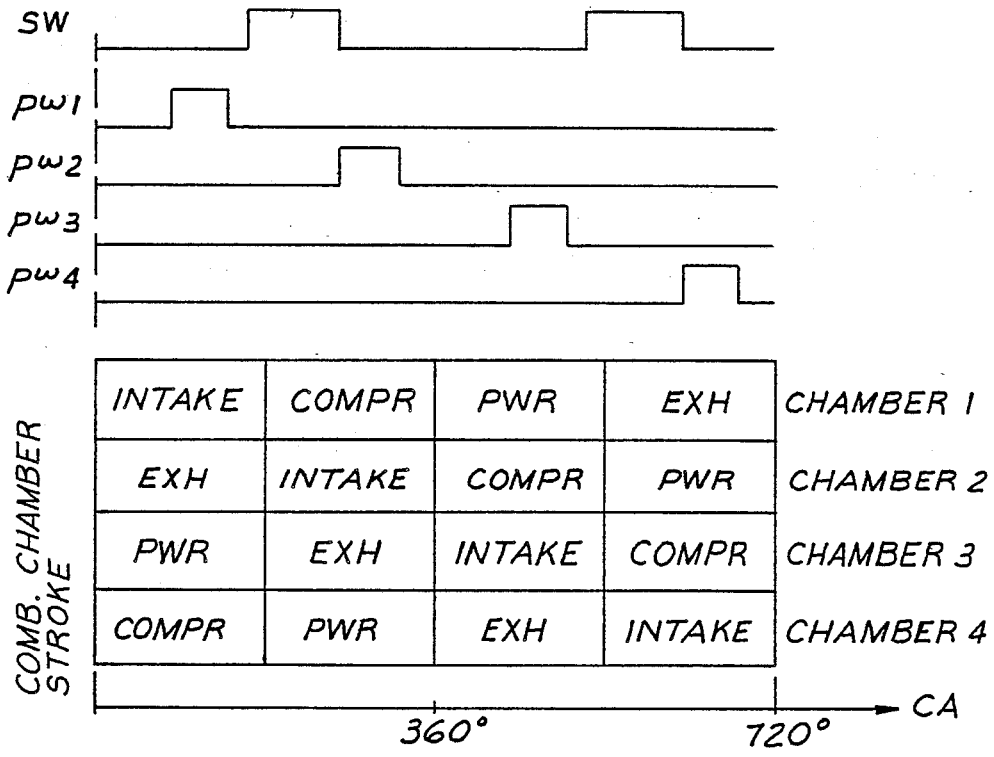
FIG. 6 shows a timing diagram for the engine and fuel control system of the alternate embodiment in which the invention is used to advantage.

An alternate embodiment is now presented with reference to FIGS. 5 and 6. The structure and operation of primary fuel injector controller 92, decision block 96, calculation block 100, feedback controller 102, and fuel vapor recovery purge system 66 are the same as presented previously herein with reference to FIGS. 1 and 3. However, as described in greater detail hereinbelow, the structure and operation of secondary fuel injector 54 and secondary fuel injector controller 94 are modified with respect to the previous example. Referring first to FIG. 5, it is seen that both auxiliary fuel injector 54 and the primary fuel injectors (40, 42, 44, and 46) have substantially the same operating characteristics. With reference to FIG. 6, secondary fuel injector controller 94 generates secondary signal sw twice per engine cycle, or once per engine revolution, rather than at each intake stroke of each combustion chamber as was the case with the previous embodiment. Accordingly, the pulse width of sw required by secondary fuel injector 54 is greater than the pulse width of $pw_1$–$pw_4$ required by each of the primary fuel injectors (40, 42, 44, and 46) to deliver the same amount of fuel to engine 12.

In operation, with reference to FIGS. 5 and 6, when $F_d$ falls below $F_{dmin}$ (such as may occur during a fuel vapor recovery purge), decision block 96 couples $F_d$ to secondary fuel injector controller 94 and decouples $F_d$ from primary fuel injector controller 92. Secondary fuel injector controller 94 scales $F_{dmin}$ to $F_{dmin}$ and provides secondary signal sw to secondary fuel injector 54 as shown by the timing diagram of FIG. 6 Thus, operation in the nonlinear range of the primary fuel injectors (40, 42, 44, and 46) is shifted to operation in the linear range of secondary fuel injector 54 ($F_{dmin}$). Accordingly, accurate fuel control is achieved which would otherwise be impeded by operation in the nonlinear range of the primary fuel injectors.

This concludes the description of the preferred embodiment. The reading of it by those skilled in the art will bring to mind many alterations and modifications without departing from the spirit and scope of the invention. For example, although multiport fuel injection is shown, it is understood that the invention may be used to advantage with other forms of fuel injection such as central fuel injection. It is also noted that secondary fuel injector 54 may be actuated any number of times per engine cycle desired by appropriately scaling the physical size of the secondary fuel injector. Accordingly, it is intended that the scope of the invention be limited only by the following claims.

I claim:

1. A fuel delivery control system for an internal combustion engine of an automobile having an intake manifold for inducting air and fuel into the combustion chambers and an exhaust manifold coupled to the exhaust chambers, comprising:

a plurality of primary fuel injectors each coupled to one of the combustion chambers for delivering fuel in proportion to the pulse width of a primary fuel control signal;

a secondary fuel injector coupled to the intake manifold upstream of said primary fuel injectors for delivering fuel in proportion to the pulse width of a secondary fuel control signal;

an airflow sensor coupled to said intake manifold for measuring airflow inducted into the engine;

an exhaust gas sensor coupled to said exhaust manifold for providing an indication of air/fuel ratio inducted into the engine;

fuel calculation means responsive to both said airflow sensor and said exhaust gas sensor for calculating a desired fuel charge related to a desired air/fuel ratio to be inducted into the engine;

first means responsive to said desired fuel charge for generating said primary fuel control signals each with a pulse width related to said desired fuel charge, each of said primary fuel control signals being generated once each engine revolution at a time related to the intake stroke of the respective combustion chamber;

second means responsive to said desired fuel charge for generating said secondary fuel control signal with a pulse width related to said desired fuel charge; and selection means responsive to said desired fuel charge for enabling said primary fuel control signals and disabling said secondary fuel control signal when said desired fuel charge is above a preselected value and for disabling said primary fuel control signals and enabling said secondary fuel control signal when said desired fuel charge is below said preselected value.

2. The fuel delivery control system recited in claim 1 wherein each of said first means generates one of each of said primary fuel control signals during an intake stroke of the respective combustion chamber.

3. The fuel delivery control system recited in claim 2 wherein said second means generates said secondary fuel control signal once each engine revolution.

4. The fuel delivery control system recited in claim 2 wherein said second means generates said secondary fuel control signal once each half engine revolution.

5. A fuel delivery control system for an internal combustion engine of an automobile having an intake manifold for inducting air and fuel from a fuel storage tank into the combustion chambers and an exhaust manifold coupled to the exhaust chambers, comprising:

at least one primary fuel injector coupled to the intake manifold for delivering fuel in proportion to the pulse width of a primary fuel control signal;

a secondary fuel injector coupled to the intake manifold for delivering fuel in proportion to the pulse width of a secondary fuel control signal;

a fuel vapor recovery system comprising a vapor storage canister coupled to the fuel storage tank and a fuel vapor purge line coupled between said canister and said intake manifold for purging fuel vapors into said intake manifold;

air/fuel feedback control means responsive to both an airflow sensor coupled to the intake manifold and an exhaust gas sensor coupled to the exhaust manifold for calculating a desired fuel charge related to a desired air/fuel ratio to be inducted into the engine;

first means responsive to said desired fuel charge for generating said primary fuel control signal with a pulse width related to said desired fuel charge;

second means responsive to said desired fuel charge for generating said secondary fuel control signal with a pulse width related to said desired fuel charge; and selection means responsive to said desired fuel charge for enabling said primary fuel control signal and disabling said secondary fuel control signal when said desired fuel charge is above a preselected value correlated with a linear range of said primary fuel injector and for disabling said primary fuel control signal and enabling said secondary fuel control signal when said desired fuel charge is below said preselected value.

* * * * *